US011555378B2

(12) United States Patent
Romer et al.

(10) Patent No.: US 11,555,378 B2
(45) Date of Patent: Jan. 17, 2023

(54) SELF-DESTRUCTIBLE FRAC BALL ENCLOSED WITHIN A DESTRUCTIBLE BALL RETAINER

(71) Applicant: ExxonMobil Upstream Research Company, Spring, TX (US)

(72) Inventors: Michael C. Romer, The Woodlands, TX (US); Timothy J. Hall, Pinehurst, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 73 days.

(21) Appl. No.: 17/207,937

(22) Filed: Mar. 22, 2021

(65) Prior Publication Data

US 2021/0317724 A1 Oct. 14, 2021

Related U.S. Application Data

(60) Provisional application No. 63/009,693, filed on Apr. 14, 2020.

(51) Int. Cl.

| | |
|---|---|
| ***E21B 29/00*** | (2006.01) |
| ***E21B 33/128*** | (2006.01) |
| ***E21B 34/14*** | (2006.01) |
| ***E21B 34/06*** | (2006.01) |
| ***E21B 33/13*** | (2006.01) |
| ***E21B 43/26*** | (2006.01) |
| ***E21B 47/06*** | (2012.01) |
| ***E21B 33/124*** | (2006.01) |

(52) U.S. Cl.

CPC ..... *E21B 34/142* (2020.05); *E21B 33/124* (2013.01); *E21B 33/13* (2013.01); *E21B 34/063* (2013.01); *E21B 43/26* (2013.01); *E21B 47/06* (2013.01); *E21B 2200/08* (2020.05)

(58) Field of Classification Search

CPC ..... E21B 33/128; E21B 33/129; E21B 33/13; E21B 29/00; E21B 29/02

See application file for complete search history.

(56) References Cited

U.S. PATENT DOCUMENTS 4,976,860 A * 12/1990 Takahashi ..... C08J 5/2275 210/500.36
7,350,582 B2 * 4/2008 McKeachnie ..... E21B 33/1294 166/194
8,127,856 B1 * 3/2012 Nish ..... E21B 33/1294 166/376

(Continued)

*Primary Examiner* — Kenneth L Thompson
(74) *Attorney, Agent, or Firm* — ExxonMobil Upstream Research Company—Law Department

(57) ABSTRACT

A self-destructible frac ball is described herein. The self-destructible frac ball is configured to seal a hydraulic flow path through a fluid conduit of a frac plug when engaged on a ball seat of the frac plug. The self-destructible frac ball includes an activation mechanism configured to activate a destructive medium in response to the satisfaction of at least one predetermined condition. The self-destructible frac ball also includes the destructive medium, which is configured to destroy the self-destructible frac ball and a corresponding destructible ball retainer when activated by the activation mechanism. The destruction of the self-destructible frac ball and the corresponding destructible ball retainer reestablishes the hydraulic flow path through the fluid conduit of the frac plug.

26 Claims, 4 Drawing Sheets

(56) References Cited

U.S. PATENT DOCUMENTS

| | | | | |
|---|---|---|---|---|
| 9,181,772 | B2 * | 11/2015 | Frazier | E21B 34/14 |
| 9,752,406 | B2 * | 9/2017 | Hardesty | E21B 43/26 |
| 10,364,642 | B1 * | 7/2019 | Rosenholm | E21B 33/129 |
| 2009/0253758 | A1 * | 10/2009 | Miller | A61P 7/00<br>514/363 |
| 2013/0062054 | A1 * | 3/2013 | Jo | E21B 43/26<br>166/250.1 |
| 2016/0013096 | A1 | 1/2016 | Doris et al. | |
| 2016/0130906 | A1 * | 5/2016 | Garvey | E21B 34/14<br>166/376 |
| 2019/0078414 | A1 * | 3/2019 | Frazier | E21B 33/134 |

* cited by examiner

100

102

104

400

SELF-DESTRUCTIBLE FRAC BALL ENCLOSED WITHIN A DESTRUCTIBLE BALL RETAINER

CROSS-REFERENCE TO RELATED APPLICATIONS

This application claims the benefit of U.S. Provisional Application 63/009,693 filed Apr. 14, 2020, the disclosure of which is hereby incorporated by reference in its entirety.

FIELD OF THE INVENTION

The techniques described herein relate to the field of well completions and downhole operations. More particularly, the techniques described herein relate to a self-destructible frac ball and destructible ball retainer that can be used to seal a frac plug during a hydraulic fracturing process wherein multiple stages of a subsurface formation are fractured in zones.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

In the drilling of oil and gas wells, a wellbore is formed using a drill bit that is urged downwardly at a lower end of a drill string. After drilling to a predetermined bottomhole location, the drill string and bit are removed, and the wellbore is lined with a string of casing. An annular area, commonly referred to as an "annulus," is thus formed between the string of casing and the surrounding subsurface formation.

A cementing operation is typically conducted to fill the annulus with columns of cement. The combination of cement and casing strengthens the wellbore and facilitates the zonal isolation of the surrounding subsurface formation.

It is common to place several strings of casing having progressively smaller outer diameters into the wellbore. The first string may be referred to as "surface casing." The surface casing serves to isolate and protect the shallower, freshwater-bearing aquifers from contamination by any other wellbore fluids. Accordingly, this casing string is almost always cemented entirely back to the surface.

A process of drilling and then cementing progressively smaller strings of casing is repeated several times below the surface casing until the well has reached total depth. In some instances, the final string of casing is a liner, that is, a string of casing that is not tied back to the surface. The final string of casing, referred to as "production casing" or "production liner," is also typically cemented into place. In some completions, the production liner has swell packers or external casing packers spaced across selected productive intervals. This creates compartments between the packers for isolation of zones and specific stimulation treatments. In this instance, the annulus may simply be packed with subsurface formation sand.

As part of the completion process, the production liner is perforated at a desired level. This means that lateral holes are shot through the liner and the cement column surrounding the liner using perforating guns. The perforations allow reservoir fluids, sometimes referred to as "production fluids," to flow into the wellbore. In the case of swell packers or individual compartments, the perforating guns penetrate the liner, allowing reservoir fluids to flow from the rock formation into the wellbore along a corresponding zone.

After the perforation process is complete, the formation is typically fractured at the corresponding zone. Hydraulic fracturing consists of injecting water with friction reducers or viscous fluids (usually shear thinning, non-Newtonian gels or emulsions) into a formation at such high pressures and rates that the reservoir rock parts and forms a network of fractures. The fracturing fluid is typically mixed with a proppant material such as sand, crushed granite, ceramic beads, or other granular materials. The proppant serves to hold the fractures open after the hydraulic pressures are released. In the case of so-called "tight," or unconventional, formations, the combination of fractures and injected proppant substantially increases the flow capacity of the treated reservoir.

In order to further stimulate the formation and to clean the near-wellbore regions downhole, an operator may choose to acidize the formation. This is done by injecting an acid solution down the wellbore and through the perforations. The use of an acidizing solution is particularly beneficial when the formation includes carbonate rock. In operation, the completion company injects a concentrated formic acid or other acidic composition into the wellbore and directs the fluid into selected zones of interest. The acid helps to dissolve carbonate material, thereby opening up porous channels through which hydrocarbon fluids may flow into the wellbore. In addition, the acid helps to dissolve drilling mud that may have invaded the formation.

Application of hydraulic fracturing and acid stimulation as described above is a routine part of petroleum industry operations as applied to individual hydrocarbon-producing formations (or "pay zones"). Such pay zones may represent hundreds of feet of gross, vertical thickness of subterranean formation. More recently, wells are being completed through hydrocarbon-bearing formations horizontally, with the horizontal portions extending several thousand feet.

When there are multiple layered formations to be hydraulically fractured, or a very thick hydrocarbon-bearing formation (over about 40 meters, or 131 feet), or where an extended-reach horizontal well is being completed, then more complex treatment techniques are required to obtain treatment of the entire target formation. Therefore, the operating company must isolate various zones to ensure that each separate zone is not only perforated, but also adequately fractured and treated. In this way, the operator is sure that fracturing fluid and stimulant are being injected through each set of perforations and into each zone of interest to effectively increase the flow capacity at each desired depth.

Treatment of a zone of interest requires isolation from all zones that have already been treated. This, in turn, involves the use of so-called diversion methods, in which injected fluid is directed towards one selected zone of interest while being diverted from other zones. The "plug-and-perforation" (or "plug-and-perf") process is a hydraulic fracturing process that utilizes diversion methods to isolate multiple zones. Specifically, the plug-and-perf process involves running a so-called "frac plug" and perforating guns into a wellbore as a plug-and-perf assembly with an electric wireline. The tools are transported into the well with gravity until the lateral, or horizontal, section is reached. At this point, the plug-and-perf assembly is hydraulically pumped into position with the frac plug acting as a hydraulic anchor. Once the frac plug is set (typically electromechanically) against the inner diameter (ID) of the production liner and released from the plug-and-perf assembly, the perforating guns are fired to perforate the production liner in the zone of interest, i.e., typically the shallowest zone of the well that has not yet been stimulated. The plug-and-perf assembly is then removed from the well, and a so-called "frac ball" is pumped into the well to seal the fluid conduit, or fluid flow path, of the frac plug. The current zone of interest is then fractured and treated. This process is then repeated for every zone of interest within the well.

During the plug-and-perf process, the frac plug and frac ball effectively act as a one-way check valve. Specifically, the frac plug and frac ball provide zonal isolation by preventing fracturing fluid from entering a previous zone. However, the frac ball will be pushed off the frac plug's ball seat in response to fluid flow in the opposite direction, thus enabling hydrocarbon fluids to flow through the well even before the frac plug is removed.

A frac plug that requires a frac ball to be pumped from the surface is the most commonly used type of frac plug for horizontal well completions. Specifically, once a zone is perforated and the perforating guns are removed from the well, a frac ball is dropped into the well from the surface, and is slowly pumped along the lateral until it ultimately seals on the frac plug. This type of frac plug enables another plug-and-perf assembly to be pumped downhole in the event that the perforating guns in the first plug-and-perf assembly fail to fire. However, if a fracture is unexpectedly initiated at any of the perforated clusters, causing some of the pumped fluids to divert to said fracture, it is possible that the frac ball will never even reach the frac plug due to insufficient fluid being moved to/through the frac plug to push the frac ball to where it can seal on the ball seat. This results in poor isolation between zones, which negatively impacts the hydraulic fracturing process.

One solution to this problem is to run a frac plug that already has the frac ball in place. The frac ball sits within a ball retainer, or cage, connected to the frac plug so that, whenever the pressure is increased inside the well to initiate the next set of fractures, the frac plug is immediately sealed by the frac ball. This approach guarantees zonal isolation within the well. However, if the perforating guns in the first plug-and-perf assembly fail to fire, it is impossible to pump another plug-and-perf assembly through the frac plug, since the ball retainer physically blocks the fluid conduit of the frac plug. As a result, the new perforating guns have to be conveyed into the well mechanically, using coiled tubing or an electric wireline tractor, for example. While these solutions are effective, they are significantly more costly and also require operational shutdowns and reconfigurations, resulting in lost efficiency.

Degradable frac balls have been developed. One such degradable frac ball is the Baker Hughes In-Tallic™ frac ball, which begins to disintegrate within 100 hours in a potassium chloride solution. However, frac balls that degrade relatively slowly, i.e., on the order of hours or days, are not always cost-effective or suitable for quickly fixing a perforating issue.

Destructible frac balls are also currently being developed. One such destructible frac ball is described in U.S. Patent Application Publication No. 2016/0130906A1, entitled "Destructible Frac-Ball and Device and Method for Use Therewith." The destructible frac ball described therein includes a rupture mechanism that is capable of selectively initiating and causing the ball to break into a number of discrete pieces. However, as described with respect to regular frac balls, it is possible that such destructible frac balls will never reach the frac plug because, once pumping is initiated, one of the new perforation clusters may break down and initiate a new fracture, thereby preventing sufficient fluid from being moved to/through the frac plug to push the destructible frac ball to where it can seal on the ball seat. Therefore, there exists a need for a frac ball configuration that will allow new perforating guns to be pumped downhole while also ensuring zonal isolation within the well.

SUMMARY OF THE INVENTION

An embodiment described herein provides a self-destructible frac ball. The self-destructible frac ball is configured to seal a hydraulic flow path through a fluid conduit of a frac plug when engaged on a ball seat of the frac plug. The self-destructible frac ball includes an activation mechanism configured to activate a destructive medium in response to the satisfaction of at least one predetermined condition. The self-destructible frac ball also includes the destructive medium, which is configured to destroy the self-destructible frac ball and a corresponding destructible ball retainer when activated by the activation mechanism. The destruction of the self-destructible frac ball and the corresponding destructible ball retainer reestablishes the hydraulic flow path through the fluid conduit of the frac plug.

In some embodiments, the at least one predetermined condition includes a predetermined pressure sequence, and the activation mechanism includes a pressure sensor configured to take pressure readings, a power source, a processor, and a memory device including executable instructions configured to direct the processor to compare the pressure readings to the predetermined pressure sequence and activate the destructive medium if the pressure readings match the predetermined pressure sequence. In other embodiments, the at least one predetermined condition includes a communication from a downhole wireless network. In other embodiments, the at least one predetermined condition includes an electrical signal transmitted through the hydrocarbon well.

In various embodiments, the self-destructible frac ball includes a body surrounded by an outer shell. The outer shell may include weak points that preferentially fail when internally stressed by the activation of the destructive medium. The destructive medium may be embedded within the body of the self-destructible frac ball. In some embodiments, the destructive medium includes a dissolving liquid that is tailored to cause the self-destructible frac ball and the corresponding destructible ball retainer to rapidly dissolve. The dissolving liquid may include at least one of a chemical reactant, brine, an acid solution, or freshwater. In other embodiments, the destructive medium includes an explosive device that causes the self-destructible frac ball and the corresponding destructible ball retainer to explode into a number of discrete pieces. The explosive device may include a detonator and an explosive material. In other embodiments, the destructive medium includes a reactive metal and an ignitor, and ignition of the reactive metal via the ignitor causes the self-destructible frac ball and the corresponding destructible ball retainer to rapidly melt. The reactive metal may include thermite, for example. Further, in other embodiments, the activation mechanism and the destructive medium are combined, and the self-destructible frac ball and the corresponding destructible ball retainer are destroyed using heat generated by a power source.

The self-destructible frac ball may be formed from at least one of a thermoplastic, a metal composite, a metal, an epoxy, a glass-reinforced epoxy resin, or a dissolvable hybrid composite. In some embodiments, the corresponding destructible ball retainer is formed from the same material as the self-destructible frac ball. In other embodiments, the corresponding destructible ball retainer is formed from a rapidly-dissolving material that dissolves independently of the destructive medium.

Another embodiment described herein provides a method for isolating a zone within a hydrocarbon well. The method includes setting a frac plug within a hydrocarbon well, wherein the frac plug includes a self-destructible frac ball retained within a destructible ball retainer. The method also includes applying a pressure to the frac plug such that the self-destructible frac ball engages with a ball seat of the frac plug, sealing a hydraulic flow path through a fluid conduit of the frac plug. The method further includes altering at least one parameter within the hydrocarbon well such that an activation mechanism within the self-destructible frac ball activates a destructive medium within the self-destructible frac ball, causing the destructive medium to reestablish the hydraulic flow path through the fluid conduit of the frac plug by destroying the self-destructible frac ball and the destructible ball retainer.

In some embodiments, the at least one parameter is altered in response to a perforating gun failure event. In some embodiments, the method also includes dropping a replacement frac ball from the surface to reseal the hydraulic flow path.

In some embodiments, altering the at least one parameter includes applying a specific pressure sequence to the hydrocarbon well. In other embodiments, altering the at least one parameter includes communicating with the activation mechanism via a downhole wireless network. Moreover, in other embodiments, altering the at least one parameter includes sending an electrical signal to the activation mechanism.

Setting the frac plug may include utilizing a setting tool to secure the frac plug against an inner diameter of a production liner of the hydrocarbon well in a zone of interest. In addition, applying the pressure to the frac plug may include injecting a fracturing fluid into the hydrocarbon well from the surface.

Another embodiment described herein provides a frac plug. The frac plug includes a mandrel that defines a fluid conduit through the frac plug and a slip ring that is configured to expand, causing an engagement structure to secure the frac plug within an inner diameter of a production liner of a hydrocarbon well. The frac plug also includes a sealing element that is configured to form a fluid seal between the frac plug and the inner diameter of the production liner. The frac plug further includes a ball seat and a self-destructible frac ball retained within a destructible ball retainer. The self-destructible frac ball is configured to seal a hydraulic flow path through the fluid conduit when engaged on the ball seat. The self-destructible frac ball includes an activation mechanism configured to activate a destructive medium in response to the satisfaction of at least one predetermined condition. The self-destructible frac ball also includes the destructive medium, which is configured to destroy the self-destructible frac ball and the destructible ball retainer when activated by the activation mechanism. The destruction of the self-destructible frac ball and the destructible ball retainer reestablishes the hydraulic flow path through the fluid conduit.

The frac plug may be used to isolate a zone within the hydrocarbon well during a hydraulic fracturing process. In some embodiments, the at least one predetermined condition includes a predetermined pressure sequence. In such embodiments, the activation mechanism includes a pressure sensor configured to take pressure readings, a power source, a processor, and a memory device including executable instructions configured to direct the processor to compare the pressure readings to the predetermined pressure sequence and activate the destructive medium if the pressure readings match the predetermined pressure sequence. In other embodiments, the at least one predetermined condition includes a communication from a downhole wireless network. In other embodiments, the at least one predetermined condition includes an electrical signal transmitted through the hydrocarbon well.

In some embodiments, the self-destructible frac ball includes a body surrounded by an outer shell. The outer shell may include weak points that preferentially fail when internally stressed by the activation of the destructive medium. The destructive medium may be embedded within the body of the self-destructible frac ball.

In some embodiments, the destructive medium includes a dissolving liquid that is tailored to cause the self-destructible frac ball and the destructible ball retainer to rapidly dissolve. In other embodiments, the destructive medium includes an explosive device that causes the self-destructible frac ball and the destructible ball retainer to explode into a number of discrete pieces. In other embodiments, the destructive medium includes a reactive metal and an ignitor, and ignition of the reactive metal via the ignitor causes the self-destructible frac ball and the destructible ball retainer to rapidly melt. Further, in other embodiments, the activation mechanism and the destructive medium are combined, and the self-destructible frac ball and the destructible ball retainer are destroyed using heat generated by a power source. The destructible ball retainer may also be formed from a rapidly-dissolving material that dissolves independently of the destructive medium.

DESCRIPTION OF THE DRAWINGS

The foregoing and other advantages of the present techniques may become apparent upon reviewing the following detailed description and drawings of non-limiting examples in which.

Figure 1:
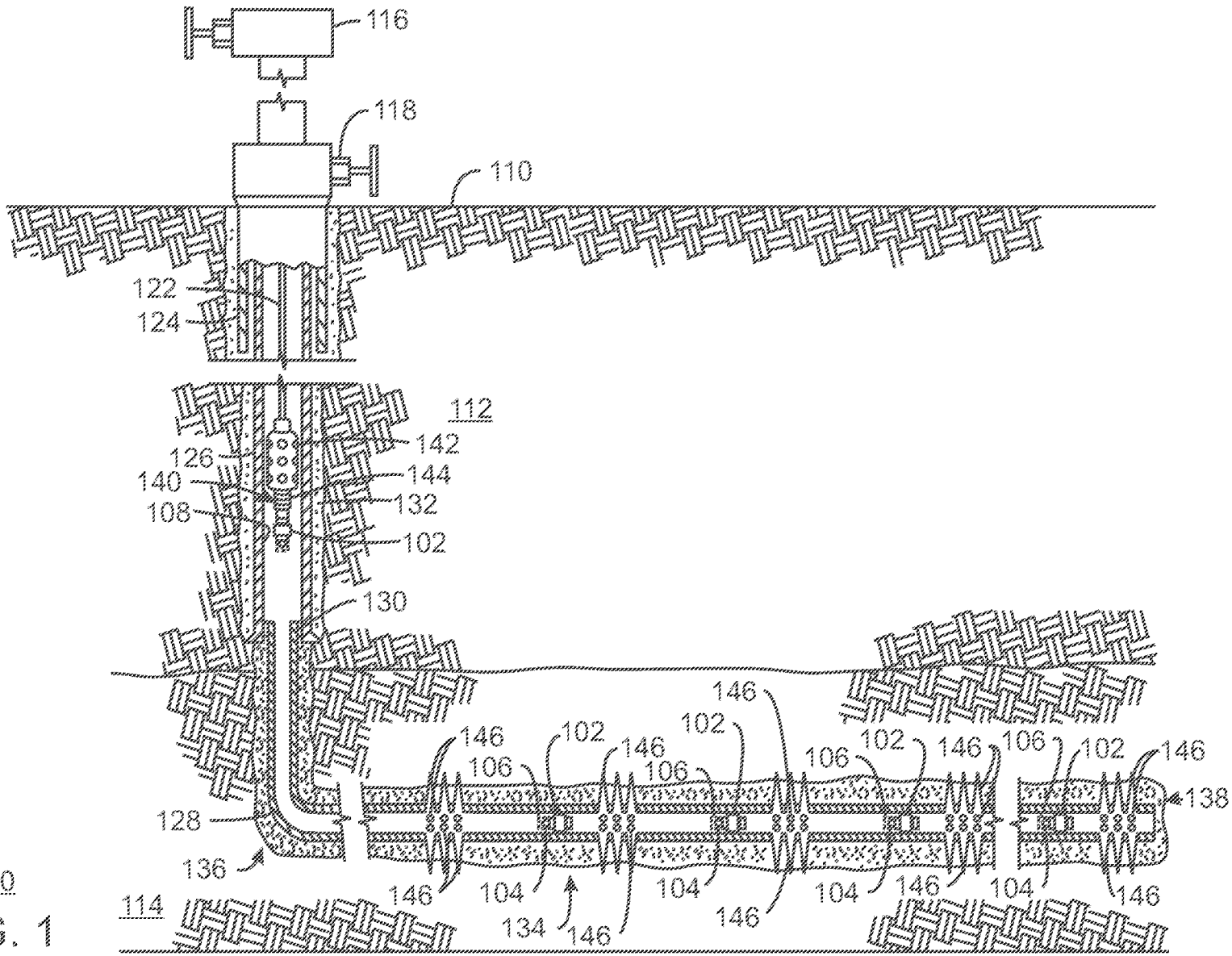
FIG. 1 is a cross-sectional schematic view of an exemplary hydrocarbon well that may utilize frac plugs including the self-destructible frac ball and destructible ball retainer described herein.

It should be noted that the figures are merely examples of the present techniques, and no limitations on the scope of the present techniques are intended thereby. Further, the figures are generally not drawn to scale, but are drafted for purposes of convenience and clarity in illustrating various aspects of the techniques.

DETAILED DESCRIPTION OF THE INVENTION

In the following detailed description section, the specific examples of the present techniques are described in connection with preferred embodiments. However, to the extent that the following description is specific to a particular embodiment or a particular use of the present techniques, this is intended to be for example purposes only and simply provides a description of the embodiments. Accordingly, the techniques are not limited to the specific embodiments described below, but rather, include all alternatives, modifications, and equivalents falling within the true spirit and scope of the appended claims.

At the outset, and for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the terms "a" and "an" mean one or more when applied to any embodiment described herein. The use of "a" and "an" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

The phrase "at least one," in reference to a list of one or more entities, should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the term "configured" mean that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "fluid" refers to gases, liquids, and combinations of gases and liquids, as well as to combinations of gases and solids, and combinations of liquids and solids.

"Formation" refers to a subsurface region including an aggregation of subsurface sedimentary, metamorphic and/or igneous matter, whether consolidated or unconsolidated, and other subsurface matter, whether in a solid, semi-solid, liquid and/or gaseous state, related to the geological development of the subsurface region. A formation can be a body of geologic strata of predominantly one type of rock or a combination of types of rock, or a fraction of strata having substantially common sets of characteristics. A formation can contain one or more hydrocarbon-bearing subterranean formations. Note that the terms "formation," "reservoir," and "interval" may be used interchangeably, but may generally be used to denote progressively smaller subsurface regions, zones, or volumes. More specifically, a "formation" may generally be the largest subsurface region, while a "reservoir" may generally be a hydrocarbon-bearing zone or interval within the geologic formation that includes a relatively high percentage of oil and gas. Moreover, an "interval" may generally be a sub-region or portion of a reservoir. In some cases, a hydrocarbon-bearing zone, or reservoir, may be separated from other hydrocarbon-bearing zones by zones of lower permeability, such as mudstones, shales, or shale-like (i.e., highly-compacted) sands.

A "hydrocarbon" is an organic compound that primarily includes the elements hydrogen and carbon, although nitrogen, sulfur, oxygen, metals, or any number of other elements may be present in small amounts. As used herein, the term "hydrocarbon" generally refers to components found in natural gas, oil, or chemical processing facilities. Moreover, the term "hydrocarbon" may refer to components found in raw natural gas, such as $CH_4$, $C_2H_6$, $C_3$ isomers, $C_4$ isomers, benzene, and the like.

As used herein, the term "self-destructible" refers to an object's ability to destroy itself after a predetermined (or predefined) condition (or set of conditions) has been satisfied, or in response to a specific input. Specifically, a self-destructible object generally contains all the components and/or mechanisms required to cause its own destruction. However, the fact that an object is self-destructible does not preclude the use of outside inputs and/or conditions to trigger, activate, and/or aid the self-destruction process. As used herein, the term "destructible" has a similar but distinct meaning. In particular, a destructible object is an object that can be readily destroyed. However, in contrast to a self-destructible object, a destructible object does not contain all the components and/or mechanisms required to cause its own destruction but, rather, relies on the influence of some outside force to cause its destruction.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing, production tubing, and other equipment that is located inside the wellbore. Moreover, according to embodiments described herein, the terms "downhole" and "subsurface" are sometimes used interchangeably, although the term "downhole" is generally used to refer specifically to the inside of the wellbore.

The terms "well" and "wellbore" refer to holes drilled vertically, at least in part, and may also refer to holes drilled with deviated, highly deviated, and/or horizontal sections. The term also includes the wellhead equipment, surface casing, intermediate casing, production liner, and the like, typically associated with oil and gas wells.

The present techniques relate to a self-destructible frac ball and destructible ball retainer that can be used to seal a frac plug during a hydraulic fracturing process within a hydrocarbon well. In some embodiments, the hydraulic fracturing process is a plug-and-perf process in which multiple stages of a subsurface formation are fractured in zones. The self-destructible frac ball and destructible ball retainer described herein are configured to isolate a zone within a hydrocarbon well by effectively sealing a frac plug. Moreover, the self-destructible frac ball and destructible ball retainer described herein provide a mechanism for reestablishing a hydraulic flow path through the frac plug on demand if, for example, there is a perforating gun failure or other similar event.

According to embodiments described herein, the self-destructible frac ball includes an activation mechanism that is configured to monitor one or more parameters within the hydrocarbon well to determine whether a predetermined (or predefined) condition (or set of conditions) has been satisfied. When the predetermined condition has been satisfied, the activation mechanism acts as a trigger, initiating the destruction of the self-destructible frac ball and the destructible ball retainer. Such destruction is accomplished using a destructive medium that is embedded within the self-destructible frac ball and is configured to cause the partial or complete destruction of the self-destructible frac ball and the surrounding destructible ball retainer when activated by the activation mechanism.

Exemplary Hydrocarbon Well Utilizing Frac Plugs with Self-Destructible Frac Balls and Destructible Ball Retainers FIG. 1 is a cross-sectional schematic view of an exemplary hydrocarbon well 100 that may utilize frac plugs 102 including the self-destructible frac ball 104 and destructible ball retainer 106 described herein. The well 100 defines a bore 108 that extends from a surface 110 into a formation 112 within the earth's subsurface. The formation 112 may include several subsurface intervals, such as a hydrocarbon-bearing interval that is referred to herein as a reservoir 114. In some embodiments, the reservoir 114 includes mostly carbonate rock layers. However, the reservoir 114 may also include any other types of rock layers, such as cemented sand layers.

The well 100 includes a wellhead 116. The wellhead 116 includes a shut-in valve 118 that controls the flow of production fluid from the well 100. The wellhead 116 also couples the well 100 to other equipment, such as equipment for running a wireline 122 into the well 100. In some embodiments, the equipment for running the wireline 122 into the well 100 includes a snubbing unit or a lubricator (not shown), which may extend as much as 75 feet above the wellhead 116. In this respect, the snubbing unit or the lubricator must be of a length greater than the length of the assembly attached to the wireline 122 to ensure that the assembly may be safely deployed into the well 100 and then removed from the well 100 under pressure. In addition, in various embodiments, the wellhead 116 couples the well 100 to a pump (not shown) and a tank (not shown) holding fracturing fluid for a hydraulic fracturing process. Furthermore, artificial lift equipment, such as a pump (not shown) or a gas lift system (not shown), may optionally be included in the well 100 to aid the movement of the production fluid from the reservoir 114 to the surface 110.

The well 100 is completed by setting a series of tubulars into the formation 112. These tubulars include several strings of casing, such as a surface casing string 124, an intermediate casing string 126, and a production casing string, which is referred to as a production liner 128. In some embodiments, additional intermediate casing strings (not shown) are also included to provide support for the walls of the well 100. According to the embodiment shown in FIG. 1, the surface casing string 124 and the intermediate casing string 126 are hung from the surface 110, while the production liner 128 is hung from the bottom of the intermediate casing string 126 using a liner hanger 130.

The surface casing string 124 and the intermediate casing string 126 are set in place using cement 132. The cement 132 isolates the intervals of the formation 112 from the well 100 and each other. The production liner 128 may also be set in place using cement 132, as shown in FIG. 1. Alternatively, the well 100 may be set as an open-hole completion, meaning that the production liner 128 is not set in place using cement.

The exemplary well 100 shown in FIG. 1 is completed horizontally. A horizontal portion is shown at 134. The horizontal portion 134 has a heel 136 and a toe 138 that extends through the reservoir 114 within the formation 112. In some embodiments, the distance between the heel 136 and the toe 138 is on the order of around 300 meters, in which case the well 100 may be referred to as an extended-reach well. In other embodiments, the distance between the heel 136 and the toe 138 is on the order of around 3,000 meters, in which case the well 100 may be referred to as an ultra-extended-reach well.

In various embodiments, a plug-and-perforation process is performed to hydraulically fracture the reservoir 114 surrounding the well 100. As shown in FIG. 1, a bottomhole assembly (BHA), referred to herein as a plug-and-perf assembly 140, is run into the well 100 via the wireline 122. The wireline 122 provides electrical signals to the surface 110 for depth control. In addition, the wireline 122 provides electrical signals to perforating guns 142 included within the plug-and-perf assembly 140. The electrical signals may allow the operator to cause the charges within the perforating guns 142 to detonate at the correct depth or zone within the well 100.

In addition to the perforating guns 142, the plug-and-perf assembly 140 includes a frac plug 102, which may also be referred to as a "fracturing plug" or a "stimulation plug," and a setting tool 144. Once the plug-and-perf assembly has reached the desired depth or zone within the well 100, the setting tool 144 is used to actuate a set of slip rings (not shown) and a sealing element (not shown) within the frac plug 102, causing the frac plug to be set against the inner diameter of the production liner 128. Moreover, during the setting process, the force generated by the setting tool 144 will cause the setting tool 144 to shear off the frac plug 102, leaving the frac plug 102 autonomous within the well 100.

Once the frac plug 102 has been set within the production liner 128, the perforating guns 142 are detonated to create a cluster of perforations 146 through the production liner 128 and the surrounding cement 132. The plug-and-perf assembly 140 is then removed from the well 100, and fracturing fluid is pumped down the well 100, through the cluster of perforations 146, and into the surrounding reservoir 114, forming fractures (not shown) in the reservoir 114. Moreover, the fracturing fluid may be mixed with proppant materials, such as sand, crushed granite, ceramic beads, or other granular materials, which serve to hold the fractures open after the hydraulic pressures are released.

In various embodiments, this plug-and-perf process is used to perforate and fracture a number of zones within the horizontal portion 134 of the well 100. As shown in FIG. 1, the area between each frac plug 102 defines a specific zone within the well 100, with the first zone being proximate to the toe 138 of the horizontal portion 134 and the last zone being proximate to the heel 136 of the horizontal portion 134.

Each frac plug 102 includes a fluid conduit (not shown) that allows fluid to flow through the frac plug 102. However, during the hydraulic fracturing process, this fluid conduit must be sealed to prevent the fracturing fluid from entering a previous zone or, in other words, to provide isolation between the zones within the well 100. Traditionally, the fluid conduit was sealed by pumping a frac ball from the surface. However, this technique does not ensure zonal isolation because the frac ball might not reach the frac plug and/or effectively seal the frac plug. Ball retainers have been developed to solve this problem. However, simply including a traditional frac ball within a traditional ball retainer attached directly to the frac plug does not allow new perforating guns to be pumped downhole if the initial perforating guns fail to fire. Furthermore, while degradable and destructible frac balls have been developed to solve the perforating gun issue, current degradable and destructible frac balls do not ensure zonal isolation because, similarly to traditional frac balls, they might not reach the frac plug and/or effectively seal the frac plug. In addition, it may take hours or days for current degradable and destructible frac balls to disappear, thus reducing the efficiency of the well completion operations.

Therefore, according to embodiments described herein, each frac plug 102 includes a self-destructible frac ball 104 retained within a destructible ball retainer 106. Because the self-destructible frac ball 104 is directly attached to the frac plug 102 and retained within the destructible ball retainer 106, the self-destructible frac ball 104 will effectively seal the frac plug 102, guaranteeing zonal isolation within the well 100. Moreover, because the self-destructible frac ball 104 is configured to destroy both itself and the destructible ball retainer 106, the hydraulic flow path through the frac plug 102 may be reestablished on demand, allowing new perforating guns to be pumped through the fluid conduit and into the previous zone when a perforating gun issue is encountered during the hydraulic fracturing process.

In some embodiments, once the new perforating guns are removed from the previous zone, another self-destructible frac ball 104 (or a traditional frac ball) may then be dropped from the surface to reseal the zone. The operator may then analyze the pressure response in the well 100 to determine whether a proper seal has occurred. Specifically, the pressure log for the well 100 may show a clear frac ball signature for the zone of interest.

The cross-sectional schematic view of FIG. 1 is not intended to indicate that the well 100 is to include all of the components shown in FIG. 1, or that the well 100 is limited to only the components shown in FIG. 1. Rather, any number of components may be omitted from the well 100 or added to the well 100, depending on the details of the specific implementation. Moreover, while FIG. 1 relates to the use of the frac plugs 102 for the plug-and-perf process, it is to be understood that the frac plugs 102 described herein may be used for any suitable type of hydraulic fracturing process. Furthermore, the self-destructible frac ball 104 and/or the destructible ball retainer 106 described herein may be used as a sealing mechanism for any other type of plug, check valve, or other similar device that would benefit from the use of a rapidly-disappearing sealing mechanism.

In some embodiments, the self-destructible frac ball 104 described herein is used in a hydraulic fracturing process that utilizes sliding sleeves. Specifically, the well 100 may include a number of sliding sleeves in place of the frac plugs 102 shown in FIG. 1. The mechanically-actuated sliding sleeves may include ball seats of progressively-larger diameter, with the smallest one being located in the zone proximate to the toe 138 of the horizontal portion 134 and the largest one being located in the zone proximate to the heel 136 of the horizontal portion 134. The corresponding self-destructible frac balls 104 may also be of progressively larger diameter. The smallest self-destructible frac ball 104 may be dropped into the well 100 first, where it passes through all the sliding sleeves until it lands on the correctly-sized ball seat corresponding to the sliding sleeve proximate to the toe 138 of the horizontal portion 134. The pressure of the self-destructible frac ball 104 against the ball seat may cause the sliding sleeve to mechanically shift, opening a number of frac ports and exposing the reservoir 114. High-pressure fracturing fluid may then be injected from the surface 110, causing a number of fractures to form in the reservoir 114. This process may then be continued with increasingly larger self-destructible frac balls 104, with the largest self-destructible frac ball 104 being inserted last. During normal operation, the self-destructible frac balls 104 will naturally flow back to the surface 110 when the well 100 is put into production. However, in some cases, it may be desirable to reestablish the hydraulic flow path through one or more sliding sleeves on demand via self-destruction of the corresponding self-destructible frac balls 104.

Frac Plug Including Self-Destructible Frac Ball and Destructible Ball Retainer

Figure 2:
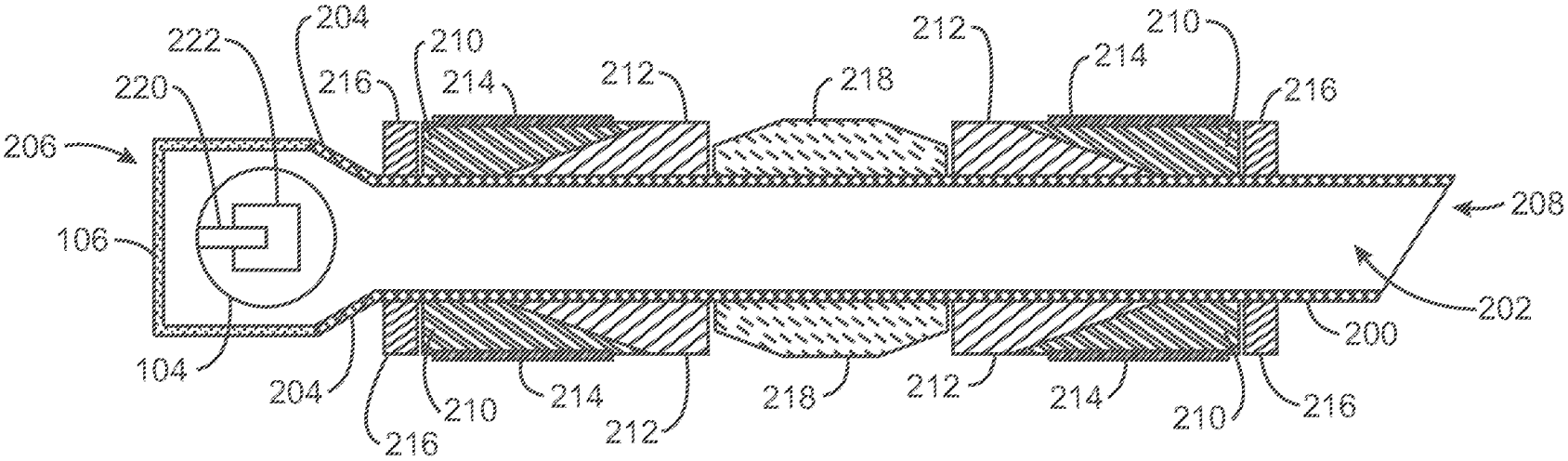
FIG. 2 is a simplified cross-sectional schematic view of an exemplary embodiment of the frac plug including the self-destructible frac ball and the destructible ball retainer.

FIG. 2 is a simplified cross-sectional schematic view of an exemplary embodiment of the frac plug 102 including the self-destructible frac ball 104 and the destructible ball retainer 106. Like numbered items are as described with respect to FIG. 1. The frac plug 102 includes a mandrel 200 that defines a fluid conduit 202 through the frac plug 102.

The mandrel 200 may include a tubular and/or hollow cylindrical structure that is configured to help position the frac plug 102 within the production liner 128, as well as retain the frac plug 102 within a desired depth or zone within the production liner 128.

The frac plug 102 also includes a ball seat 204 proximate to the self-destructible frac ball 104. The ball seat 204 may be a conical seat, as shown in FIG. 2, or it may be a concave seat that matches the geometry of the self-destructible frac ball 104. When fluid pressure is applied to an uphole end 206 of the frac plug 102, such as when fracturing fluid is injected into the well 100, the self-destructible frac ball 104 engages with the ball seat 204, sealing the fluid conduit 202 and restricting fluid flow from the uphole end 206 to a downhole end 208 of the frac plug 102. In other words, the hydraulic flow path through the fluid conduit 202 is sealed in the downhole direction. However, when fluid pressure is applied to the downhole end 208 of the frac plug 102, such as when the well 100 is put into production, the self-destructible frac ball 104 moves away from the ball seat 204, opening the hydraulic flow path through the fluid conduit 202 and allowing fluid flow from the downhole end 208 to the uphole end 206 of the frac plug 102. In other words, the hydraulic flow path through the fluid conduit 202 is opened in the uphole direction. In this manner, the frac plug 102 effectively acts as a one-way check valve within the well 100.

According to embodiments described herein, the frac plug 102 also includes the destructible ball retainer 106. The destructible ball retainer 106 is configured to retain the self-destructible frac ball 104 proximate to the ball seat 204. In various embodiments, the destructible ball retainer 106 is a ball cage that is capable of being readily destroyed by the self-destructible frac ball 104. For example, the destructible ball retainer 106 may be formed from the same, or a similar, destructible material as the self-destructible frac ball 104, as described further with respect to FIG. 3. Further, in various embodiments, the destructible ball retainer 106 is made from a permeable material and/or includes a number of holes or slots that allow fluid to pass through the destructible ball retainer 106 to enter or exit the fluid conduit 202 of the frac plug 102.

The frac plug 102 also includes a number of slip rings 210 with corresponding cones 212 that work in conjunction with the mandrel 200 to maintain the frac plug 102 within the inner diameter of the production liner 128. Specifically, the slip rings 210 include respective engagement structures 214, and the mandrel 200 is configured to press the slip rings 210 against and/or over the cones 212 such that the slip rings 210 expand and the engagement structures 214 operatively engage the inner diameter of the production liner 128. The mandrel 200 may also include two end caps 216 that are configured to urge the slip rings 210 over the cones 212 and, thus, aid in the expansion of the slip rings 210.

The frac plug 102 further includes a sealing element 218 that is configured to form a fluid seal between the frac plug 102 and the inner diameter of the production liner 128 when the slip rings 210 are in the expanded configuration. The sealing element 218 may be formed from any suitable material, such as, for example, a polymer, a biodegradable polymer, a water-soluble polymer, a metal foil, an extrudable compound, polylactic acid (PLA), and/or polyglycolic acid (PGA).

According to embodiments described herein, the self-destructible frac ball 104 includes an activation mechanism 220 and a destructive medium 222. When the activation mechanism 220 senses that a predetermined condition (or set of conditions) has been satisfied, the activation mechanism 220 activates the destructive medium 222. The destructive medium 222 then causes the destruction of the self-destructible frac ball 104 and the destructible ball retainer 106, reestablishing the hydraulic flow path through the fluid conduit 202 of the frac plug 102 in the downhole direction. Exemplary embodiments of the particular components of the self-destructible frac ball 104 and the means by which such destruction may occur are described in more detail with respect to FIG. 3.

The cross-sectional schematic view of FIG. 2 is not intended to indicate that the frac plug 102, the self-destructible frac ball 104, and/or the destructible ball retainer 106 are to include all of the components shown in FIG. 2. Moreover, the frac plug 102, the self-destructible frac ball 104, and/or the destructible ball retainer 106 may include any number of additional components not shown in FIG. 2, depending on the details of the specific implementation. Furthermore, it is to be understood that the frac plug 102 shown in FIG. 2 is merely one exemplary embodiment of a frac plug that may be utilized according to embodiments described herein. However, the self-destructible frac ball 104 and the destructible ball retainer 106 described herein may be included within any suitable type of frac plug, frac sleeve, or similar device.

Figure 3:
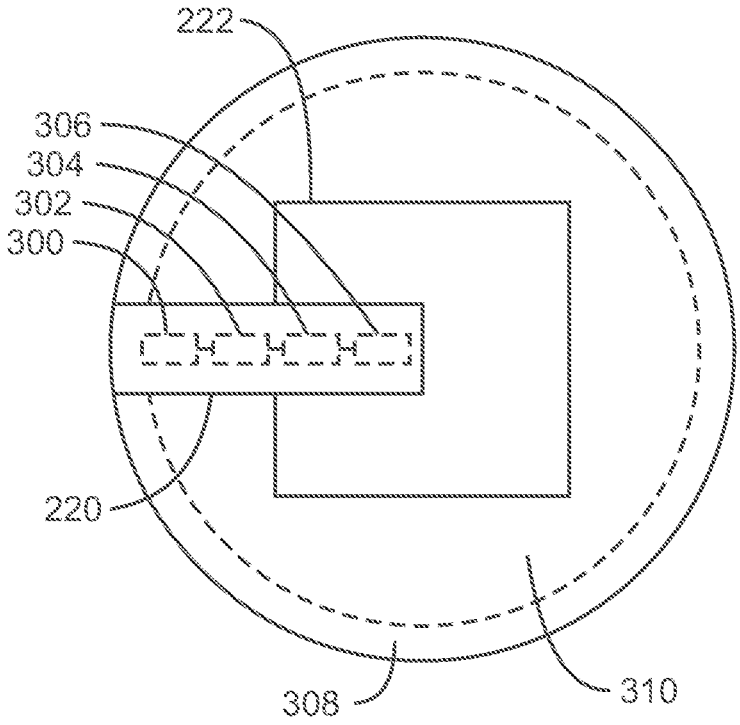
FIG. 3 is a cross-sectional schematic view of an exemplary embodiment of the self-destructible frac ball.

FIG. 3 is a cross-sectional schematic view of an exemplary embodiment of the self-destructible frac ball 104. Like numbered items are as described with respect to FIGS. 1 and 2. In various embodiments, the self-destructible frac ball 104 is a disappearing-on-demand frac ball that is configured to reestablish a hydraulic flow path through the fluid conduit 202 of the frac plug 102 automatically in response to the satisfaction of one or more predetermined conditions. The self-destruction of the frac ball 104 may occur rapidly, i.e., on the order of minutes or hours, to prevent interruptions in the hydraulic fracturing process in the event of a perforating gun failure.

The self-destructible frac ball 104 includes a number of active internal components. Specifically, as described with respect to FIG. 2, the self-destructible frac ball 104 includes the activation mechanism 220 and the destructive medium 222. The activation mechanism 220 is configured to monitor one or more parameters within the well 100 in the vicinity of the self-destructible frac ball 104 to determine whether a predetermined condition (or set of conditions) has been satisfied. When the predetermined condition has been satisfied, the activation mechanism 220 acts as a trigger, initiating the destruction of the self-destructible frac ball 104 (and the destructible ball retainer 106) via the destructive medium 222. According to embodiments described herein, the components of the activation mechanism 220 may vary depending on the type of predetermined condition(s) required to trigger the self-destruction process. Moreover, the composition of the destructive medium 222 may vary depending on the type of destruction which will occur, as described further herein.

As shown in FIG. 3, the activation mechanism 220 may include an electronic circuit. The electronic circuit includes a pressure sensor 300, a power source 302, a memory device 304, and a processor 306 capable of processing executable instructions stored in the memory device 304. In some embodiments, the power source 302 includes one or more batteries and, optionally, a battery housing, and the pressure sensor 300 includes a low-power pressure sensor that can operate on battery power for one or more days. Moreover, the executable instructions included in the memory device 304 may direct the processor 306 to make decisions and/or perform actions, such as activating the destructive medium 222 in response to the detection of one or more predetermined conditions within the well 100, such as specific pressure readings from the pressure sensor 300, as described further herein. Further, in some embodiments, the electronic circuit of the activation mechanism 220 additionally (or alternatively) includes other types of sensors, such as temperature sensors, flow rate sensors, magnetic sensors, electromagnetic sensors, or pH sensors, for example.

In some embodiments, the activation mechanism 220 is configured to initiate the self-destruction process in response to the application of specific pressure signals that do not occur during normal hydraulic fracturing operations, such as holding a specific pressure for a certain amount of time and/or applying a certain series of pressure spikes or pressure pulses. Such pressure signals may be applied via injection of the fracturing fluid into the well 100 from the surface 110. For example, when the pressure sensor 300 senses a stable pressure of a few hundred pounds per square inch (psi) for a given period of time, followed by a series of rapid, oscillating pressure step-ups and step-downs, the processor 306 may compare this pressure sequence to an onboard reference stored within the memory device 304 and confirm that the conditions for self-destruction have been satisfied. As another example, when the pressure sensor 300 senses a pressure that exceeds a predetermined pressure threshold of, for example, around 2,000 psi more than the well's operating pressure, the processor 306 may compare this pressure signal to an onboard reference stored within the memory device 304 and confirm that the conditions for self-destruction have been satisfied. In either example, such confirmation may trigger the activation mechanism 220 to initiate the self-destruction of the self-destructible frac ball 104 (and the destructible ball retainer 106) via the destructive medium 222. Furthermore, in other embodiments, the activation mechanism 220 may be configured to initiate the self-destruction process in response to radio communication with a downhole wireless network or an electrical signal transmitted through the well 100 to the downhole location of the self-destructible frac ball 104, for example.

In various embodiments, the self-destructible frac ball 104 is made out of a material with sufficient integrity to withstand the high pressure differential within the well 100, but with the ability to readily disintegrate into discrete pieces during the self-destruction process. Stated another way, the material should be solid enough to hold together under normal applied pressure inside the well 100, but weak enough to break apart during the self-destruction process. Specifically, the self-destructible frac ball 104 may be made out of thermoplastics, metal composites, metals, epoxies, glass-reinforced epoxy resins, dissolvable hybrid composites, and/or any other suitable materials, depending on the type of destructive medium 222 included within the self-destructible frac ball 104.

The self-destructible frac ball 104 may include an outer shell 308 and a body 310. In some embodiments, the outer shell 308 and the body 310 are made out of the same material(s). However, in other embodiments, the outer shell 308 is made out of a weaker material than the body 310 and/or includes weak points that will preferentially fail when internally stressed via the activation of the destructive medium 222. Such weak points may include thin-walled or hollowed-out spots on the outer shell 308 of the self-destructible frac ball 104.

In various embodiments, the self-destructible frac ball 104 is not completely destroyed during the self-destruction process. Instead, once the outer diameter of the self-destructible frac ball 104 is smaller than the inner diameter of the ball seat 204, the self-destructible frac ball 104 falls through to the toe 138 of the well 100 and continues to degrade until it completely disappears. In such embodiments, it may be sufficient for only the outer shell 308 of the self-destructible frac ball 104 to be destroyed. In other embodiments, the entire self-destructible frac ball 104 may be broken into a number of discrete pieces, and the discrete pieces may fall through to the toe 138 of the well 100 and continue to degrade until they completely disappear. In either embodiment, the destructive medium 222 is configured to destroy the self-destructible frac ball 104 and the destructible ball retainer 106 without damaging the ball seat 204 or other components of the corresponding frac plug 102.

As shown in FIG. 3, the destructive medium 222 is encapsulated and/or embedded within the body 310 of the self-destructible frac ball 104. The destructive medium 222 is configured to cause the destruction of the surrounding material when freed. Specifically, the destructive medium 222 is configured to cause the self-destructible frac ball 104 and the corresponding destructible ball retainer 106 to dissolve, disintegrate, melt, or explode in a controlled manner. For example, the destructive medium 222 may include a dissolving liquid, such as a chemical reactant, brine, an acid solution, or even freshwater, that is specifically tailored to cause the self-destructible frac ball 104 and the destructible ball retainer 106 to rapidly dissolve. As another example, the destructive medium 222 may include an explosive device that causes the self-destructible frac ball 104 and the destructible ball retainer 106 to explode into a number of discrete pieces. The explosive device may include a detonator and an explosive material, such as lead azide, zirconium potassium perchlorate (ZPP), gasless ignition powder, pentaerythritol tetranitrate (PETN), cyclotrimethylenetrinitramine (RDX), or diazodinitrophenol (DDNP), for example. As yet another example, the destructive medium 222 may include thermite (or another similar reactive metal) and an ignitor. When the destructive medium 222 is activated, the ignitor may rapidly increase the temperature of the thermite to a temperature in excess of 3,000° F. This, in turn, may cause the thermite to produce very high temperatures of over 4,000° F., rapidly melting the self-destructible frac ball 104 and the destructible ball retainer 106 from the inside out. Further, as another example, the activation mechanism 220 and the destructive medium 222 may be combined, and the self-destructible frac ball 104 may be destroyed from the inside using heat generated by the onboard power source 302.

In various embodiments, the destructible ball retainer 106 is made from the same material as the self-destructible frac ball 104, or the same material as the outer shell 308 of the self-destructible frac ball 104. Therefore, the destructible ball retainer 106 may be destroyed using the same destructive medium 222 that destroys the self-destructible frac ball 104. However, in other embodiments, the destructible ball retainer 106 is made out of a rapidly-dissolving material, which may be different from the material of the self-destructible frac ball 104. In such embodiments, the destructible ball retainer 106 may begin dissolving before the destructive medium 222 is activated. Since the destructible ball retainer 106 is only needed to ensure that the self-destructible frac ball 104 seals against the ball seat 204 at the onset of the perforation process for each zone, the early destruction (or partial destruction) of the destructible ball retainer 106 will not adversely affect the hydraulic fracturing process.

The self-destructible frac ball 104 and destructible ball retainer 106 described herein ensure reliable zonal isolation within the well 100, while also providing a contingency for a perforating gun failure event. As described herein, after the self-destruction process, the compromised self-destructible frac ball 104 (and the remnants of the destructible ball retainer 106) may be forced through the fluid conduit 202 of the frac plug 102, reestablishing the hydraulic flow path to the previously-fractured zone. Perforating guns may then be pumped back into the current zone of interest to allow for proper perforation of that zone. A replacement frac ball may then be dropped from the surface 110. In some embodiments, the replacement frac ball may be another self-destructible frac ball 104 while, in other embodiments, the replacement frac ball may be a standard frac ball.

The cross-sectional schematic view of FIG. 3 is not intended to indicate that the self-destructible frac ball 104 is to include all of the components shown in FIG. 3. Moreover, the self-destructible frac ball 104 may include any number of additional components not shown in FIG. 3, depending on the details of the specific implementation.

Figure 4:
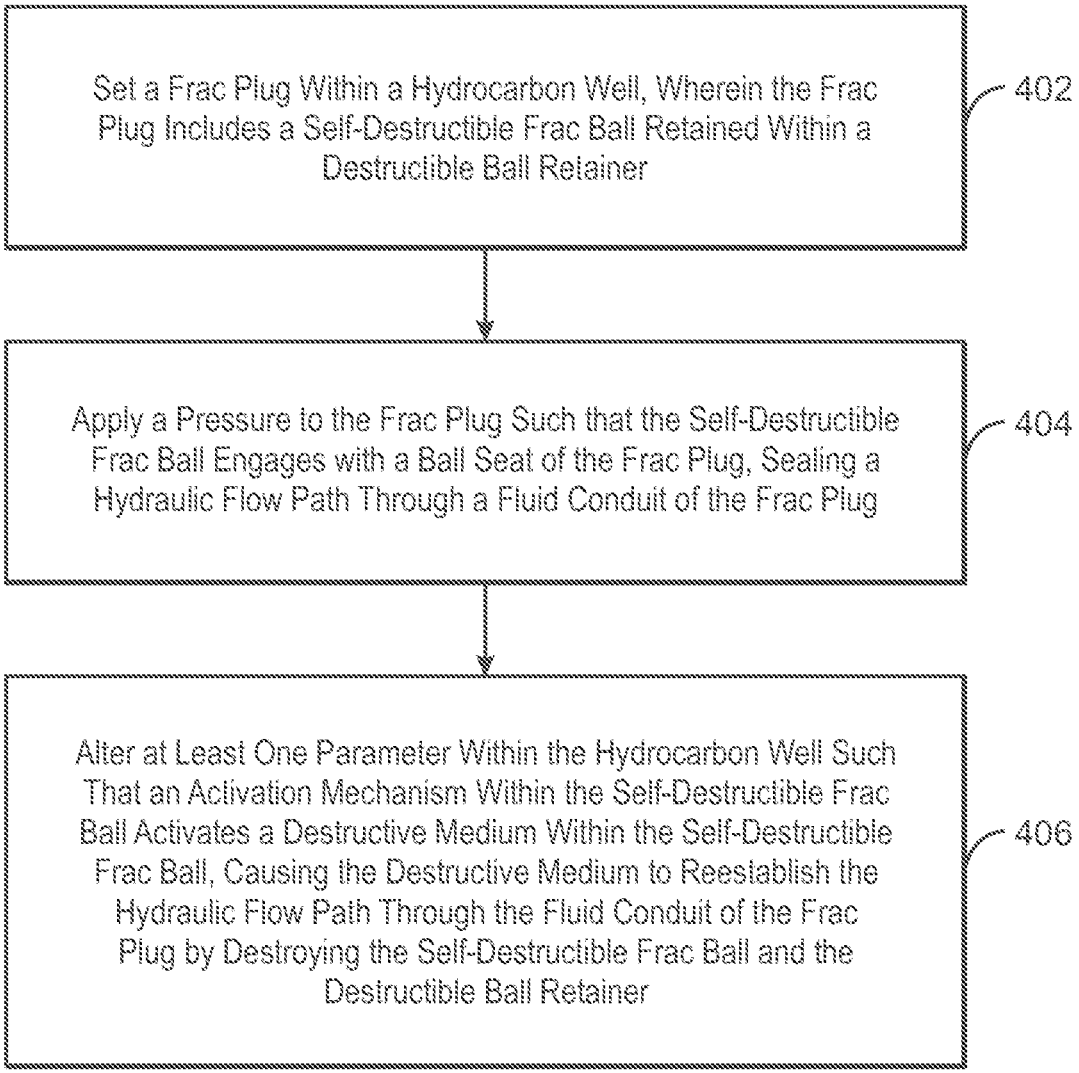
FIG. 4 is a process flow diagram of a method for isolating a zone within a hydrocarbon well using a frac plug including a self-destructible frac ball retained within a destructible ball retainer, wherein the self-destructible frac ball is configured to reestablish a hydraulic flow path through the frac plug on demand.

Method for Isolating a Zone within a Hydrocarbon Well Using a Frac Plug Including a Self-Destructible Frac Ball Retained Within a Destructible Ball Retainer FIG. 4 is a process flow diagram of a method 400 for isolating a zone within a hydrocarbon well using a frac plug including a self-destructible frac ball retained within a destructible ball retainer, wherein the self-destructible frac ball is configured to reestablish a hydraulic flow path through the frac plug on demand. The method 400 begins at block 402, at which a frac plug including a self-destructible frac ball retained within a destructible ball retainer is set within a hydrocarbon well. In some embodiments, this is accomplished by utilizing a setting tool to secure the frac plug against an inner diameter of a production liner of the hydrocarbon well in a zone of interest.

At block 404, a pressure is applied to the frac plug such that the self-destructible frac ball engages with a ball seat of the frac plug, sealing a hydraulic flow path through a fluid conduit of the frac plug. In some embodiments, this is accomplished by injecting a fracturing fluid into the hydrocarbon well from the surface.

At block 406, at least one parameter is altered within the hydrocarbon well such that an activation mechanism within the self-destructible frac ball activates a destructive medium within the self-destructible frac ball, causing the destructive medium to reestablish the hydraulic flow path through the fluid conduit of the frac plug by destroying the self-destructible frac ball and the destructible ball retainer. In some embodiments, this is performed in response to a perforating gun failure event.

In some embodiments, the at least one parameter includes applying a specific pressure sequence to the hydrocarbon well. In other embodiments, the at least one parameter includes communicating with the activation mechanism via a downhole wireless network. Further, in other embodiments, the at least one parameter includes sending an electrical signal to the activation mechanism.

The process flow diagram of FIG. 4 is not intended to indicate that the steps of the method 400 are to be executed in any particular order, or that all of the steps of the method 400 are to be included in every case. Further, any number of additional steps not shown in FIG. 4 may be included within the method 400, depending on the details of the specific implementation. For example, in some embodiments, the method 400 also includes dropping a replacement frac ball from the surface to reseal the hydraulic flow path.

Embodiments described herein relate to the use of the self-destructible frac ball and destructible ball retainer for sealing a frac plug during a plug-and-perforation process. However, the self-destructible frac ball and destructible ball retainer may be used for any application in which it is desirable to seal a plug (or other similar device) in a manner that allows the plug to be rapidly unsealed, i.e., via the destruction of the frac ball and the ball retainer, upon the satisfaction of one or more predetermined conditions. Moreover, while the embodiments described herein are well-calculated to achieve the advantages set forth, it will be appreciated that the embodiments described herein are susceptible to modification, variation, and change without departing from the spirit thereof. Indeed, the present techniques include all alternatives, modifications, and equivalents falling within the true spirit and scope of the appended claims.

What is claimed is:

1. A self-destructible frac ball, wherein the self-destructible frac ball is configured to seal a hydraulic flow path through a fluid conduit of a frac plug when engaged on a ball seat of the frac plug, and wherein the self-destructible frac ball comprises:

an activation mechanism configured to activate a destructive medium in response to the satisfaction of at least one predetermined condition; and the destructive medium configured to destroy the self-destructible frac ball and a corresponding destructible ball retainer when activated by the activation mechanism, wherein the self-destructible frac ball comprises a body surrounded by an outer shell with weak points that preferentially fail when internally stressed by the activation of the destructive medium;

wherein the destruction of the self-destructible frac ball and the corresponding destructible ball retainer reestablishes the hydraulic flow path through the fluid conduit of the frac plug.

2. The self-destructible frac ball of claim 1, wherein the at least one predetermined condition comprises a predetermined pressure sequence, and wherein the activation mechanism comprises:

a pressure sensor configured to take pressure readings;

a power source;

a processor; and a memory device comprising executable instructions configured to direct the processor to:

compare the pressure readings to the predetermined pressure sequence; and activate the destructive medium if the pressure readings match the predetermined pressure sequence.

3. The self-destructible frac ball of claim 1, wherein the at least one predetermined condition comprises a communication from a downhole wireless network.

4. The self-destructible frac ball of claim 1, wherein the at least one predetermined condition comprises an electrical signal transmitted through the hydrocarbon well.

5. The self-destructible frac ball of claim 1, wherein the destructive medium is embedded within the body of the self-destructible frac ball.

6. The self-destructible frac ball of claim 1, wherein the destructive medium comprises a dissolving liquid that is tailored to cause the self-destructible frac ball and the corresponding destructible ball retainer to rapidly dissolve.

7. The self-destructible frac ball of claim 6, wherein the dissolving liquid comprises at least one of a chemical reactant, brine, an acid solution, or freshwater.

8. The self-destructible frac ball of claim 1, wherein the destructive medium comprises an explosive device that causes the self-destructible frac ball and the corresponding destructible ball retainer to explode into a plurality of discrete pieces.

9. The self-destructible frac ball of claim 8, wherein the explosive device comprises a detonator and an explosive material.

10. The self-destructible frac ball of claim 1, wherein the destructive medium comprises a reactive metal and an ignitor, and wherein ignition of the reactive metal via the ignitor causes the self-destructible frac ball and the corresponding destructible ball retainer to rapidly melt.

11. The self-destructible frac ball of claim 10, wherein the reactive metal comprises thermite.

12. The self-destructible frac ball of claim 1, wherein the activation mechanism and the destructive medium are combined, and wherein the self-destructible frac ball and the corresponding destructible ball retainer are destroyed using heat generated by a power source.

13. The self-destructible frac ball of claim 1, wherein the self-destructible frac ball is formed from at least one of a thermoplastic, a metal composite, a metal, an epoxy, a glass-reinforced epoxy resin, or a dissolvable hybrid composite.

14. The self-destructible frac ball of claim 1, wherein the corresponding destructible ball retainer is formed from a same material as the self-destructible frac ball.

15. The self-destructible frac ball of claim 1, wherein the corresponding destructible ball retainer is formed from a rapidly-dissolving material that dissolves independently of the destructive medium.

16. A method for isolating a zone within a hydrocarbon well, comprising:

setting a frac plug within a hydrocarbon well, wherein the frac plug comprises a self-destructible frac ball retained within a destructible ball retainer;

applying a pressure to the frac plug such that the self-destructible frac ball engages with a ball seat of the frac plug, sealing a hydraulic flow path through a fluid conduit of the frac plug; and altering at least one parameter within the hydrocarbon well such that an activation mechanism within the self-destructible frac ball activates a destructive medium within the self-destructible frac ball, causing the destructive medium to reestablish the hydraulic flow path through the fluid conduit of the frac plug by destroying the self-destructible frac ball and the destructible ball retainer;

wherein altering the at least one parameter comprises applying a specific pressure sequence to the hydrocarbon well.

17. The method of claim 16, comprising altering the at least one parameter within the hydrocarbon well in response to a perforating gun failure event.

18. The method of claim 16, further comprising dropping a replacement frac ball from a surface to reseal the hydraulic flow path.

19. The method of claim 16, wherein altering the at least one parameter comprises communicating with the activation mechanism via a downhole wireless network.

20. The method of claim 16, wherein altering the at least one parameter comprises sending an electrical signal to the activation mechanism.

21. The method of claim 16, wherein setting the frac plug comprises utilizing a setting tool to secure the frac plug against an inner diameter of a production liner of the hydrocarbon well in a zone of interest.

22. The method of claim 16, wherein applying the pressure to the frac plug comprises injecting a fracturing fluid into the hydrocarbon well from a surface.

23. A frac plug, comprising:

a mandrel that defines a fluid conduit through the frac plug;

a slip ring that is configured to expand, causing an engagement structure to secure the frac plug within an inner diameter of a production liner of a hydrocarbon well;

a sealing element that is configured to form a fluid seal between the frac plug and the inner diameter of the production liner;

a ball seat; and a self-destructible frac ball retained within a destructible ball retainer, wherein the self-destructible frac ball is configured to seal a hydraulic flow path through the fluid conduit when engaged on the ball seat, and wherein the self-destructible frac ball comprises:

an activation mechanism configured to activate a destructive medium in response to the satisfaction of at least one predetermined condition; and the destructive medium configured to destroy the self-destructible frac ball and the destructible ball retainer when activated by the activation mechanism, wherein the self-destructible frac ball comprises a body surrounded by an outer shell with weak points that preferentially fail when internally stressed by the activation of the destructive medium;

wherein the destruction of the self-destructible frac ball and the destructible ball retainer reestablishes the hydraulic flow path through the fluid conduit.

24. The frac plug of claim 23, wherein the frac plug is used to isolate a zone within the hydrocarbon well during a hydraulic fracturing process.

25. The frac plug of claim 23, wherein the at least one predetermined condition comprises a predetermined pressure sequence, and wherein the activation mechanism comprises:

a pressure sensor configured to take pressure readings;

a power source;

a processor; and a memory device comprising executable instructions configured to direct the processor to:

compare the pressure readings to the predetermined pressure sequence; and activate the destructive medium if the pressure readings match the predetermined pressure sequence.

26. A self-destructible frac ball, wherein the self-destructible frac ball is configured to seal a hydraulic flow path through a fluid conduit of a frac plug when engaged on a ball seat of the frac plug, and wherein the self-destructible frac ball comprises:

an activation mechanism configured to activate a destructive medium in response to the satisfaction of at least one predetermined condition, wherein the at least one predetermined condition comprises a predetermined pressure sequence, and wherein the activation mechanism comprises:

a pressure sensor configured to take pressure readings;

a power source;

a processor; and a memory device comprising executable instructions configured to direct the processor to:

compare the pressure readings to the predetermined pressure sequence; and activate the destructive medium if the pressure readings match the predetermined pressure sequence; and the destructive medium configured to destroy the self-destructible frac ball and a corresponding destructible ball retainer when activated by the activation mechanism;

wherein the destruction of the self-destructible frac ball and the corresponding destructible ball retainer reestablishes the hydraulic flow path through the fluid conduit of the frac plug.

* * * * *